United States Patent [19]

Ramm et al.

[11] Patent Number: 4,888,845

[45] Date of Patent: Dec. 26, 1989

[54] SWEEPING APPARATUS FOR RAILWAY BALLAST REGULATORS

[75] Inventors: Edmund C. Ramm, Holland; John J. Nogan, II, South Hampton, both of Pa.

[73] Assignee: Railway Track-Work Company, Bethayres, Pa.

[21] Appl. No.: 182,140

[22] Filed: Apr. 15, 1988

Related U.S. Application Data

[63] Continuation-in-part of Ser. No. 775,848, Sep. 13, 1985, abandoned.

[51] Int. Cl.[4] ..... A46B 13/02

[52] U.S. Cl. ..... 15/182; 15/55; 15/159 A; 15/188

[58] Field of Search ..... 15/179, 181, 182, 183, 15/54, 55, 191, 159 R, 159 A, 200, 186, 198

[56] References Cited

U.S. PATENT DOCUMENTS

| | | | |
|---|---|---|---|
| 420,640 | 2/1890 | Day | 15/54 |
| 3,137,018 | 6/1964 | Seffker | 15/55 |
| 4,077,081 | 3/1978 | Drumm | 15/181 |
| 4,484,373 | 11/1984 | Price | 15/179 X |
| 4,707,875 | 11/1987 | Wachter | 15/183 |

FOREIGN PATENT DOCUMENTS

| | | | |
|---|---|---|---|
| 864087 | 1/1953 | Fed. Rep. of Germany | 15/179 |

*Primary Examiner*—Peter Feldman

*Attorney, Agent, or Firm*—Kerkam, Stowell, Kondracki & Clarke

[57] ABSTRACT

An improved broom element, means for loosely attaching the broom element to a broom element holder and orientation of broom elements on a broom reel of a railway ballast regulator is provided. The apparatus significantly reduces the time and effort required for maintenance of broom elements and reduces the stresses which can increase the wear on the broom elements and the sweeper unit of the ballast regulator.

7 Claims, 2 Drawing Sheets

SWEEPING APPARATUS FOR RAILWAY BALLAST REGULATORS

RELATED APPLICATIONS

This application is a continuation-in-part of application Ser. No. 775,848, filed Sept. 13, 1985, now abandoned .

BACKGROUND OF INVENTION

The present invention relates to sweeper units and, in particular, broom elements and their mounting means used on railway ballast regulators. Ballast regulators are employed to perform such functions as plowing and sweeping the gravel (or "ballast") surrounding and supporting railway tracks and ties.

Existing sweeper units employing solid broom elements use broom reels with the broom elements aligned parallel to the axis of the broom reel. The effect of this arrangement is to create a considerable vibration caused by the striking (or "thumping") against the ballast at one time of all the broom elements in a given row.

The broom elements presently utilized take one of three basic forms: solid cylindrical rods, solid squared isosceles trapezoid or solid horseshoe shape rods and a hollow tube or plugged hollow tubes. All of these elements have been constructed of various compounds and combinations of materials in an effort of improving element life and sweeping action. Traditionally, the hollow tube form has been the most popular due to the ability to substitute readily available used train brake hoses for the hollow tubes. However, the solid form of broom elements are more durable and perform superior sweeping function over the ballast surface.

In the case of the first two types of elements, attachment to the broom reel in machines in use today has involved the use of clamping holders which rigidly retain the broom elements in place through friction by compressing the broom elements. Such an arrangement is shown, for example, in U.S. Pat. No. 4,484,373. These clamping holders require considerable pressure to retain the broom elements in place; as such, replacement of broom elements is a burdensome procedure requiring compression of broom elements and manipulation of bolting and fastening means on the clamping holders. Replacement of broom elements is further handicapped by the tendency of the clamping means to become fixed due to the considerable pressure involved and the exposure of the holders to adverse environmental conditions. Additionally, the construction of the holders for these elements has been such that the one side of the holder receiving the side of the broom elements upon impact is contoured but the other side of the holder (i.e. the side which receives the rebounding broom element) is a straight, non-contoured edge. The result is that these holders tend to prematurely damage broom elements by unduly stressing the broom elements at the impact point between the broom element and the holder upon rebound.

Tightly clamped broom elements also present another problem of high stress in the broom element at the point where the clamp holding the broom element terminates. The repeated flexure of the broom element at the clamping point actually heats the broom element and very often the broom element will fail at that point before the end of the broom element has worn to the point of requiring replacement.

Attachment of hollow tubes has been accomplished by inserting the tube over a stepped nipple element. Although stepped nipple elements can be readily arranged to avoid the aforementioned "thumping" problem, this form of broom element has other severe limitations. By the very nature of stepped nippled elements, considerable manipulation and pressure must be asserted to the hollow tubes in order to install and replace them. Moreover, hollow tubes have a shorter life and are not as durable as solid broom elements.

A problem present with all of the aforementioned designs is that the broom elements located over the tracks, which are some 7 inchs higher than the rest of the surface being swept, tend to receive extreme punishment and deteriorate much faster than the other broom elements. Although hollow tube broom elements used with stepped nipple holders tend to be more forgiving under the stresses caused by the closer sweeping surface of the rails, the combination of the hollow tubes and the stepped nipple elements do not sweep as well or last as long as is desired with respect to the sweeping of the ballast surface.

OBJECTS OF INVENTION

It is an object of the present invention to provide a broom reel for a ballast regulator employing solid broom elements which maintains a relatively equal number of broom elements on the ballast at all times during sweeping thus avoiding the vibration caused by an entire row of broom elements striking the ballast at one time.

It is a further object of the present invention to provide a broom element and holder which cooperate to provide a relatively long life of the broom element and exceptional ballast sweeping characteristics.

It is an additional object of the present invention to provide a broom element and holder which cooperate to permit rapid and easy replacement of the broom elements when they are worn or damaged.

It is yet another object of the present invention to provide a broom reel with a hybrid arrangement of broom elements and holders so to maximize the efficiency of the sweeping action and minimize the wear of the broom elements over both the ballast and the rails.

Finally, it is an object of the present invention to provide a modified broom reel incorporating all the aforementioned objective characteristics which may be utilized with existing ballast regulators.

SUMMARY OF THE INVENTION

The present invention addresses improvements in the design, orientation and means for attaching broom elements to sweeper units of railway ballast regulators. The present invention employs solid cylindrical tubes as broom elements which have two opposite sides extruded to create flat striking and rebound surfaces. The broom elements are loosely attached to the broom reel of the sweeper unit by means of a novel broom element holder which employs a bolt or pin and cotter pin arrangement. This design drastically reduces when in the secured end of the broom element and simplifies the maintenance and replacement of broom elements. Additionally, the broom element holder has contoured lateral sides which limits the stresses which can be caused by the broom element striking the sides of the broom element holder during the flex and rebound of sweeping. This significantly reduces wear on the broom elements.

Arranging the solid broom element holders in a helical fashion around the broom reel of the sweeper unit eliminates the vibration and noise caused by all the broom elements in a row striking the ballast simultaneously. Instead, an approximately equal number of broom elements will remain in contact with the ballast at all times. Creating a hybrid design by arranging stepped nipple broom element holders adapted to receive hollow tube broom elements over the train rails reduces the wear and improves sweeping over the rail area.

The present invention improves the sweeping action of the sweeping unit while reducing wear on the broom elements and the sweeper unit. Moreover, the present invention significantly reduces the time and effort which must be exerted in order to maintain the sweeper unit of a ballast regulator.

DESCRIPTION OF THE DRAWINGS

The operation, features and advantages of the present invention should become apparent from the following description when considered in conjunction with the accompanying drawings, in which.

DETAILED DESCRIPTION OF THE INVENTION

Figure 1:
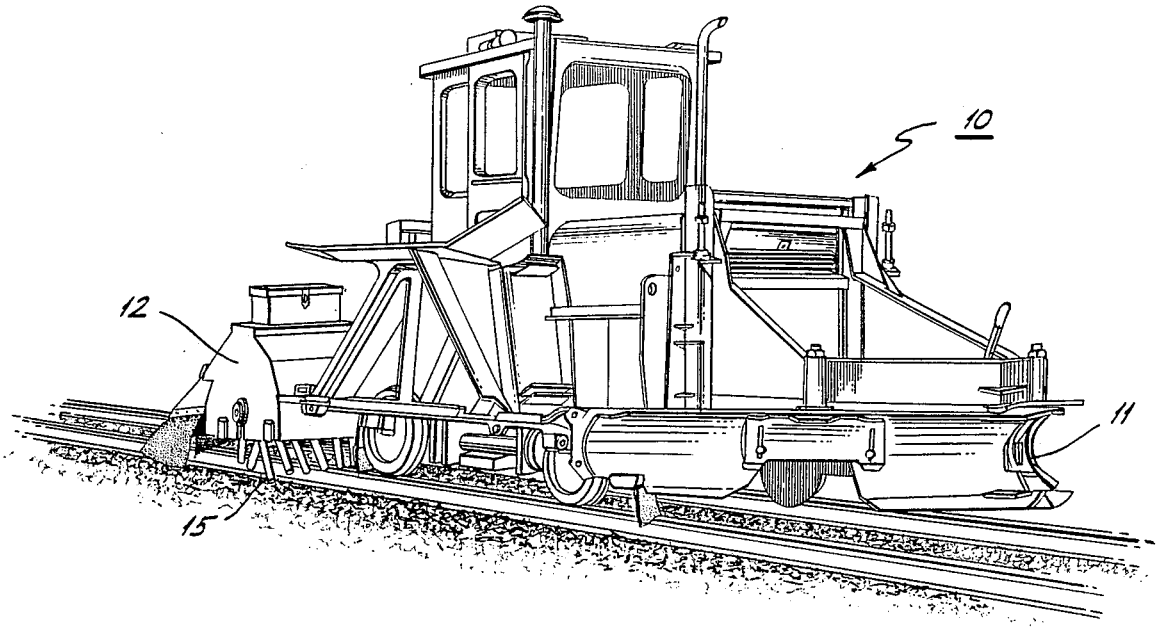
FIG. 1 is a perspective view of a ballast regulator showing the positioning of a sweeper unit.
Figure 2:
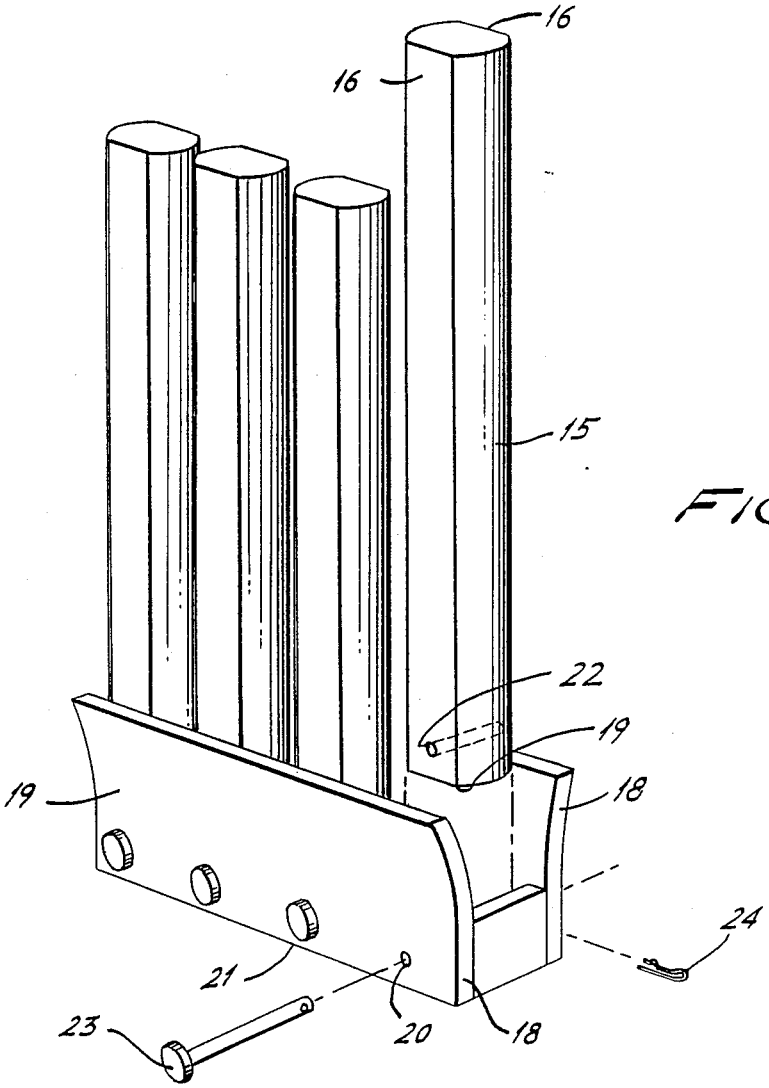
FIG. 2 is a three-quarter view of a four-element broom element holder of the present invention, the first broom element and its attachment means shown in exploded orientation.

There is illustrated in the drawings a ballast regulator 10 of known construction incorporating a plow unit 11 on one end and a sweeper unit 12 on the other end. The sweeper unit 12 is used to sweep the gravel and other material forming and covering the ballast for the railway track to a uniform height and consistency.

Within the sweeper unit 12 is a motor driven broom reel 13. Attached, such as by welding, to the broom reel 13 are a plurality of broom element holders 14 which each removably provide attachment for one or more broom elements 15. The present invention employs two forms of broom elements 15 and two forms of corresponding broom elements holders 14 and 14*a*.

The primary broom elements 15 of the present invention are of a unique construction. Each primary broom element 15 comprises a cylindrical rod of hard rubber, such as two-inch diameter KLEENSWEEP solid round regulator tube available from T. C. Johnson Company of Chargin Falls, Ohio, which has been extruded on two opposite sides to provide two opposite flat faces 16, 16 of the broom element 15 running parallel to the axis of the broom element 15 for its entire length.

The primary broom element holders 14 corresponding to the primary broom elements 15 are also of a unique construction. Each primary holder 14 contains two lateral sides 18, 18 which are each curved, or "contoured," away from the interior of the primary holder 14. Each primary holder 14 contains three or four seats 17 each adapted to receive a base 19 of one of the primary broom elements 15. Each seat 17 has an aperture 20, 20 drilled in each of the lateral sides 18 of the primary holder 14 approximately one inch above the bottom 21 of the primary holder 14 and directly across from one another.

The thickness of the broom elements 15 between the two opposite flat faces 16, 16 is slightly less than the distance between the two lateral sides 18, 18 of the primary holders 14. This difference in dimensions may be up to as much as $\frac{5}{8}$ of an inch. This dimensional difference provides ease of insertion of the broom elements into the holders and also relieves stress as hereinafter discussed.

In order to attach the primary broom elements 15 to the primary holder 14, each primary broom element has a hole 22 drilled through it between its two extruded faces 16 approximately one inch above its base 19 and corresponding with the apertures 20 in each of the lateral sides 18 of each seat 17 of the primary holder 14. A bolt or smooth pin 23 is provided for each primary broom element 15 adapted to pass through the apertures 20, 20 and the hole 22 in the broom element 15. The bolt or pin 23 is adapted to be fastened by a cotter pin 24 at the end of the bolt 23 exiting the primary holder 14.

In this manner, the primary broom elements 15 are securely but loosely fastened to the broom reel 13 without complicated and burdensome compression-type element holders which are difficult to manipulate. Moreover, the nature of cotter pin attachment greatly eases removal of worn primary broom elements 15 and is not prone to becoming fixed or "frozen" due to adverse environmental conditions. Additionally, this loose securing arrangment permits the secured end of the broom element to move relatively freely within the holder 14 and its seat 17. In this manner, the stress heretofore experienced in clamped broom elements is greatly reduced and the life of the broom element in this region extended up to four times that heretofore experienced. Further, the flat faces 16 of the broom elements working in conjunction with the flat surfaces of the lateral sides 18 of the holder 14 absorb and transfer the energy of impact during sweeping and further reduce wear of the broom elements 15.

In the embodiment shown in the drawings, the pin and cotter pin arrangement and the associated apertures in the holder and broom element are transverse to the broom reel axis. This is necessitated by the plural seat aspect of the holders. However, in the case where single seat holders may be used, the pin and apertures could be positioned parallel to the broom reel axis.

The dual curve design of the lateral sides 18, 18 is also provided to further reduce the wear caused to the primary broom element 15 when it strikes the ballast and is flexed against a lateral side 18 of the primary holder 14 and when it rebounds back into the opposite lateral side 18 of the primary holder 14 upon leaving the ballast. Although contouring the holder 14 to receive the broom element 15 during the flex of impact against the ballast is known in the art, the inventors have found that substantial damage is also incurred upon rebound after the broom element 15 has left the ballast. Accordingly, the operational life of the primary broom elements can be significantly extended by contouring both lateral sides 18 of the holder 14. It should be noted that unlike some other broom element holder means presently used, the use of the cotter pin-type attachment need not have a straight lateral side in order properly to receive and hold the broom element and thus is capable of employing he dual curve design herein discussed.

Figure 3:
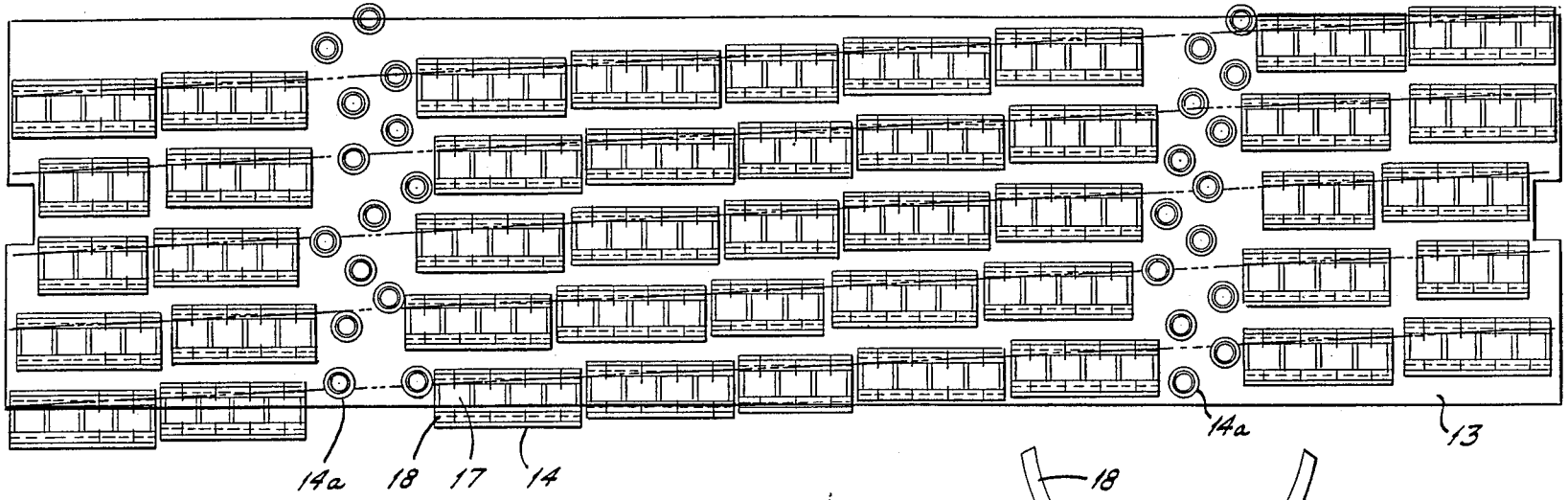
FIG. 3 is a broom reel embodying the present invention and shown as if the reel has been cut parallel to its axis and the circumference of the cylinder laid flat.
Figure 4:
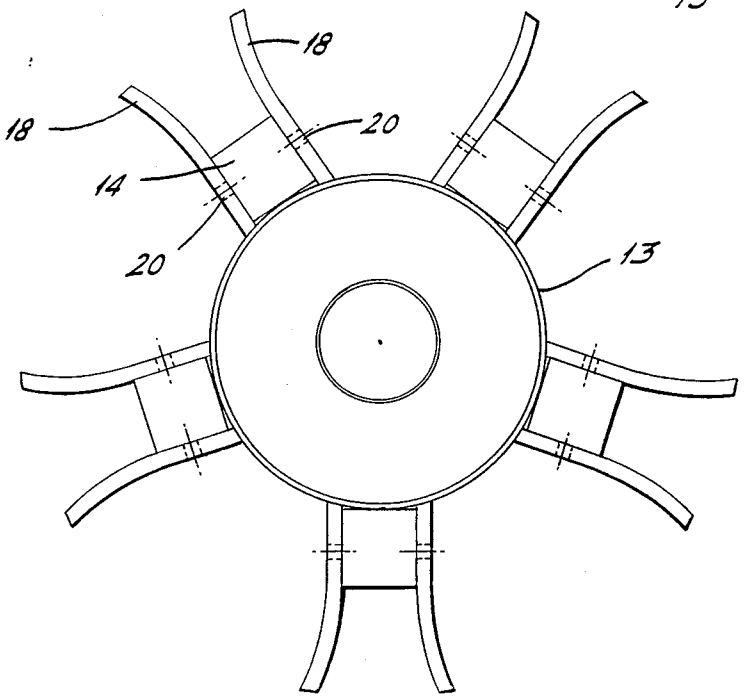
FIG. 4 is a cross-sectional view of the broom reel of the present invention showing the orientation of five of the broom element holders around the circumference of the broom reel.

The secondary broom elements (not shown) and their corresponding secondary broom element holder 14*a* are of known construction. It has been found that hollow tube broom elements and their corresponding stepped nipple holders 14*a* function very adequately when sweeping the area over the train rails. Accordingly, as seen in FIG. 3, the broom reel 13 is designed to have the stepped nipple holders 14*a*, 14*a*, arranged over the train rails so that hollow tube broom elements can be used to sweep the rails. These may be cut shorter than the primary broom elements 15 so to accommodate the higher sweeping surface of the rails. Hard rubber hollow regulator tubes, such as the approximately 2.25 inch outside diameter KLEENSWEEP hollow regulator tube available from T. C. Johnson Company of Chargin Falls, Ohio, is preferred for this application because it is easier to install than used brake hose. However, two staged nipples with a flexible extension of known construction may be used as secondary holders 14*a* so to permit the use of used brake hose, which should have a somewhat longer operational life.

As is depicted in FIG. 3, the broom element holders 14, 14*a* are not arranged in straight rows parallel with the axis of the broom reel 13. The primary holders 14 are aligned on rows of an approximately three (3) degree spiral or helix around the broom reel 13. The secondary holders 14*a* over the rails are randomly staggered. In this manner, an approximately equal number of solid broom elements 15 will be contacting the ballast at an given time. This avoids the vibration and noise that occurs with the broom reels presently utilized which have the solid broom elements all aligned in straight rows and which thus have an entire row of broom elements strike the ballast surface simultaneously.

While particular embodiments of the present invention have been disclosed herein, it is not intended to limit the invention to such a disclosure and changes and modifications may be incorporated and embodied within the scope of the following claims.

What we claim is:

1. A railway broom sweeping unit comprising:

broom reel;

a plurality of broom element holders affixed to the broom reel and each having opposed side walls parallel to the axis of the broom reel and spaced apart a first distance;

a plurality of broom elements having parallel side walls at a first end thereof spaced apart a distance less than that of the spacing between the opposed side walls of the broom element holder and adapted to fit loosely within the broom element holder when the respective parallel sides are in alignment; and securing means for loosely interconnecting the broom element with the broom element holder at its first end permitting relative movement of the broom element within the broom element holder.

2. The railway broom sweeping unit of claim 1 wherein the securing means is a pin cooperating with aligned apertures in the broom element holder and the first end of the broom element.

3. The railway broom sweeping unit of claim 2 wherein the apertures are through the opposed side walls of the broom element holder and perpendicular to the parallel side walls of the broom element.

4. The railway broom sweeping unit of claim 3 wherein the opposed side walls of the broom element holders at their upper extremities are contoured away from the interior of the broom element holder.

5. The railway broom sweeping unit of claim 4 wherein the broom element holders are arranged in a helical disposition around the circumference of the broom reel.

6. The railway broom sweeping unit of claim 1 wherein each broom element holder includes therein a plurality of seats for retaining a plurality of broom elements.

7. The railway broom sweeping unit of claim 6 wherein the broom element holders are arranged helically around the broom reel.

* * * * *